United States Patent [19]

White

[11] 4,454,681

[45] Jun. 19, 1984

[54] METHOD AND MEANS OF SECURING A PLANT POT TO A SHELF

[76] Inventor: Charles J. White, 1032 - 121st St., Rock Island, Ill. 61201

[21] Appl. No.: 441,443

[22] Filed: Nov. 15, 1982

[51] Int. Cl.[3] ..... A47G 7/02

[52] U.S. Cl. ..... 47/39; 47/58; 248/500

[58] Field of Search ..... 47/1 A, 62, 63, 65, 47/68, 83, 39, 40, 40.5, 67, 41, 41.11, 41.13, 41.2, 41.12, 32, 33; 248/154, 500, 503; 24/243 B, 287

[56] References Cited

U.S. PATENT DOCUMENTS

| | | | |
|---|---|---|---|
| 168,673 | 10/1875 | Rosenfeld | 248/154 |
| 492,919 | 3/1893 | Gridley | 47/39 X |
| 1,448,808 | 3/1923 | McGowan | 47/39 X |
| 1,874,189 | 8/1932 | Goldstein | 47/41.2 |
| 2,641,382 | 6/1953 | Mason | 248/154 X |

*Primary Examiner*—Robert A. Hafer
*Assistant Examiner*—Danton DeMille
*Attorney, Agent, or Firm*—Zarley, McKee, Thomte, Voorhees & Sease

[57] ABSTRACT

A method and means of securing a plant pot to its shelf. This method and means includes a bracket which is placed inside the pot and has a portion extending through the drainage hole of the pot. A threaded screw hook extending through the shelf is hooked to the bracket and held in place with a washer and nut.

2 Claims, 3 Drawing Figures

METHOD AND MEANS OF SECURING A PLANT POT TO A SHELF

BACKGROUND OF THE INVENTION

Growing potted plants is a hobby of many people. Such plants can be very valuable, particularly bonsai plants which grow to be several hundred years old. These plants must be left outside so as to receive the necessary sunlight for proper growth. Being outside subjects the potted plant to being blown off the shelf by winds. Furthermore, because of their value, theft of the plants is a threat. Also, when it is necessary to move the plants, such moving can be a tedious task when there are many plants.

Therefore, the principal objective of the present invention is to provide a means and method for securely attaching a potted plant to its shelf.

It is further objective of the present invention to provide a means for preventing a planted pot from being blown off the shelf by the wind.

It is a further objective of the present invention to provide a means for deterring theft of a valuable potted plant.

It is a further objective of the present invention to provide a means for easily moving several potted plants at one time.

It is a further objective of the present invention to provide a means for securing a potted plant to its shelf which is economical to manufacture, durable in use, and efficient in operation.

SUMMARY OF THE INVENTION

The means and method for attaching a plant pot to a shelf includes a bracket with a crossbar extending across its diameter, a screw hook with a hook at one end and threads at the other end, and a washer and nut that can be threaded onto the screw hook. The bracket is placed inside the plant pot so that a U-shaped portion on the crossbar extends into the drainage hole of the pot. The hook end of the screw hook is placed over the U-shaped portion of the crossbar and the threaded end of the screw hook is extended through the shelf. The washer is placed over the threaded end of the screw hook and the nut is threaded onto the screw hook and tightened so as to securely fasten the plant pot to the shelf.

DETAILED DESCRIPTION OF THE DRAWINGS

Figure 1:
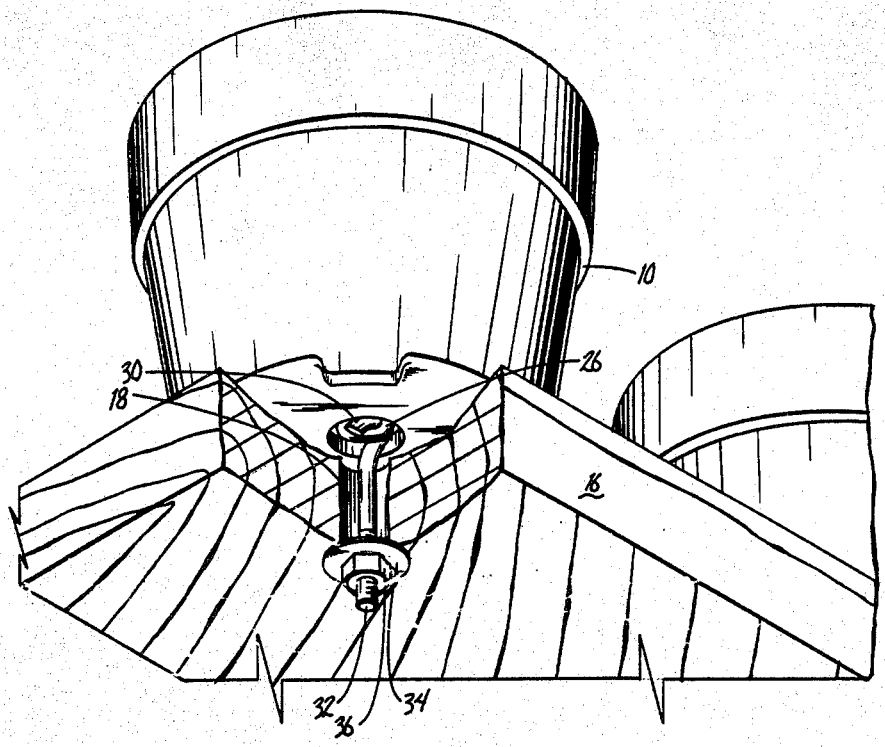
FIG. 1 is a sectional perspective view of the plant pot securing means in use.
Figure 2:
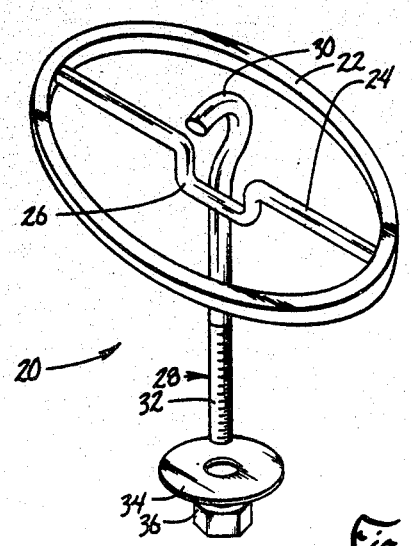
FIG. 2 is an exploded perspective view of the plant pot securing means.

In the drawings, numeral 10 designates the plant pot with drainage hole 12. There is a shelf 16 with a corresponding hole 18 that aligns with the drainage hole 12 of the pot 10.

The securing means is generally designated by numeral 20. The securing means includes a circular bracket 22 with a crossbar 24 extending across the diameter of bracket 22. Crossbar 24 has a U-shaped portion 26 at its center. Numeral 28 generally designates the screw hook having a hook 30 at one end and being threaded at the opposite end 32. A washer 34 fits over the threaded end 32 and a corresponding nut 36 screws onto end 32 so as to tighten the securing means 20.

Figure 3:
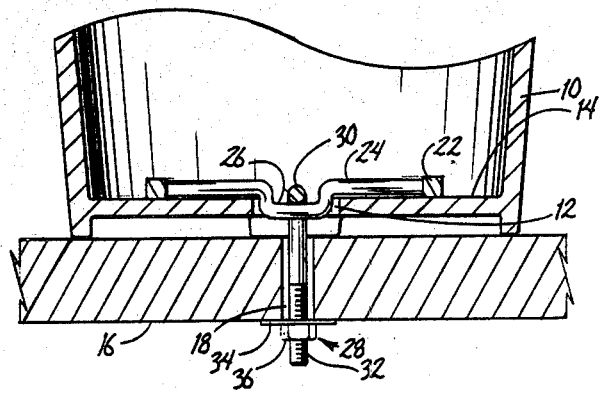
FIG. 3 is a sectional view of the plant pot securing means in use.

FIGS. 3 shows that the bracket 22 fits inside the pot and rests against the bottom 14 of the pot 10. U-shaped portion 26 of crossbar 24 extends into the drainage hole 12 of pot 10. Hook 30 is placed over the U-shaped portion 26 and the threaded end 32 of screw hook 28 is then inserted into hole 18 of the shelf 16. Washer 34 is then placed over end 32 and nut 36 is screwed on until the washer 34 is snugly engaged with shelf 16.

It can be seen that means 20 securely fastens pot 10 to shelf 16 so that the pot will not be blown off the shelf by the wind. Means 20 also deters theft of the pot due to the increased work necessary to remove the pot. Securing means 20 also provides an easy method of quickly and safely moving potted plants that are securely fastened to a shelf by such means.

Thus, it can be seen that at least all of the stated objectives are accomplished by the present invention.

What is claimed is:

1. In combination a plant pot and means securing said plant pot to a shelf, said plant pot having a bottom wall with a drain hole therein, said shelf having an upper surface, a lower surface, and a vertical bore extending therethrough; said pot resting on said upper surface of said shelf with said drain hole in registered alignment with said bore; said securing means comprising:

bracket means within said pot, said bracket means having a crossbar with a length greater than the diameter of said drain hole of said pot, said crossbar having opposite horizontal ends with a U-shaped portion therebetween, said U-shaped portion being fit within said drain hole with said opposite ends resting on said bottom wall of said pot;

said bracket means being sized so as to leave at least a portion of said drain hole unobstructed when said U-shaped portion is within said drain hole for permitting moisture to drain through said drain hole;

an elongated member having an upper end formed into an open ended hook and having a threaded lower end, said open ended hook being shaped and sized to fit within said drain hole, said open ended hook retentively engaging said U-shaped portion of said crossbar within said drain hole;

said elongated member extending completely through said vertical bore of said shelf with said threaded lower end protruding downwardly below said lower surface of said shelf, and with said hook retentively engaging said U-shaped portion within said drain hole;

washer means mounted on said lower end of said elongated member and having a diameter greater than said bore; and nut means threaded on said lower end of said elongated member, said nut means holding said washer means thereon and forcing said washer against said bottom surface of said shelf.

2. A method for securing a plant pot to a shelf, said plant pot having a bottom wall and a drain hole extending through said bottom wall, said shelf having an upper surface and a lower surface, said method comprising:

placing an elongated crossbar having opposite horizontal ends and a U-shaped portion between said opposite ends into said pot with said U-shaped portion extending within said drain hole and with said horizontal ends resting on said bottom wall of said pot;

hooking an open hook on one end of an elongated member over said U-shaped portion with said elongated member extending downwardly through said drain hole to a threaded lower end, boring a vertical bore through said shelf, extending said lower threaded end of said elongated member downwardly through said bore to a position wherein said pot is resting on said upper surface of said shelf with said lower threaded end protruding downwardly from said lower surface of said shelf;

placing a nut and washer on said elongated member, said washer being larger than the diameter of said bore;

tightening said nut and washer against said bottom surface of said shelf whereby said open hook holds said crossbar and said pot against said upper surface of said shelf; and leaving at least a portion of said drain hole unobstructed when said open hook and said crossbar are within said drain hole whereby water will freely drain through said drain hole.

* * * * *